US005605504A

United States Patent [19]

Huang

[11] Patent Number: 5,605,504

[45] Date of Patent: Feb. 25, 1997

[54] ELECTRONIC WAGERING MACHINE

[76] Inventor: Sming Huang, 45 Stouts La., Suite 8, Monmouth Junction, N.J. 08852

[21] Appl. No.: 431,275

[22] Filed: Apr. 28, 1995

[51] Int. Cl.[6] ..... A63F 1/18; A63F 3/06

[52] U.S. Cl. ..... 463/22; 463/12; 463/17; 463/13; 463/18

[58] Field of Search ..... 273/85 CP, 138 A, 273/139, 292, 269; 364/412; 271/278, 292; 463/10–13, 16–19, 22; 232/1 R, 11, 23

[56] References Cited

U.S. PATENT DOCUMENTS

| | | | |
|---|---|---|---|
| 4,191,376 | 3/1980 | Goldman et al. | 273/139 |
| 4,299,637 | 11/1981 | Oberdeck et al. | 273/139 |
| 4,373,719 | 2/1983 | Nelson et al. | 273/85 CP |
| 4,373,726 | 2/1983 | Churchill et al. | 273/139 |
| 4,470,356 | 9/1984 | Davis et al. | 271/292 |
| 4,494,197 | 1/1985 | Troy et al. | 364/412 |
| 4,560,161 | 12/1985 | Hamano | 273/85 CP |
| 4,677,553 | 6/1987 | Roberts | 463/17 |
| 4,678,178 | 7/1987 | Akiyama et al. | 271/266 |
| 4,760,527 | 7/1988 | Sidley | 273/85 CP |
| 4,810,120 | 3/1989 | Narita et al. | 400/624 |
| 4,858,122 | 8/1989 | Kreisner | 364/412 |
| 4,926,327 | 5/1990 | Sidley | 364/412 |
| 4,995,615 | 2/1991 | Cheng | 273/85 CP |
| 5,092,598 | 3/1992 | Kamille | 273/139 |
| 5,295,181 | 3/1994 | Kuo | 379/100 |
| 5,464,200 | 11/1995 | Nakazato et al. | 271/297 |
| 5,507,491 | 4/1996 | Gatto et al. | 273/139 |
| 5,513,013 | 4/1996 | Kuo | 271/290 |

*Primary Examiner*—Jessica Harrison
*Assistant Examiner*—Mark A. Sager
*Attorney, Agent, or Firm*—John Lezdey & Associates

[57] ABSTRACT

The instant invention provides a method and apparatus for simulating a game of chance in which the player or players play a proactive role and in which the player may verify the probity of the device once play has been completed. This involves generating a sequence consisting of a finite number of hidden playing cards or numbers, randomizing the sequence and displaying the sequence in a predetermined arrangement. The improvement broadly includes enabling a player or players to select, and reveal if required, as many of the hidden playing cards or numbers of the arrangement sufficient to enable completion of the game, and revealing all of the playing cards or numbers of the arrangement only after the game is completed by the player or players.

The revealing improvement more specifically includes two (2) major variants: 1. (a) generating a printout of the revealed entirety of playing cards or numbers; (b) directly thereafter receiving the printout face-down in a locked enclosure; and, (c) opening the enclosure only after the game has been completed; or 2. (a) generating a printout of the revealed entirety of playing cards or numbers; (b) transferring the printout to a position under an opaque cover that is placed within a sealed transparent enclosure; and, (c) displacing the opaque cover from over the printout only after the game is completed. The improvement of (1) or (2) may result in a printout that is a long, narrow tape upon which each element of said entirety is printed in sequence or the improvement may provide at least one video monitor for displaying the predetermined arrangement before the game has started, and provide means for disclosing said entirety only after said game has been completed.

16 Claims, 15 Drawing Sheets

FIG. 5a
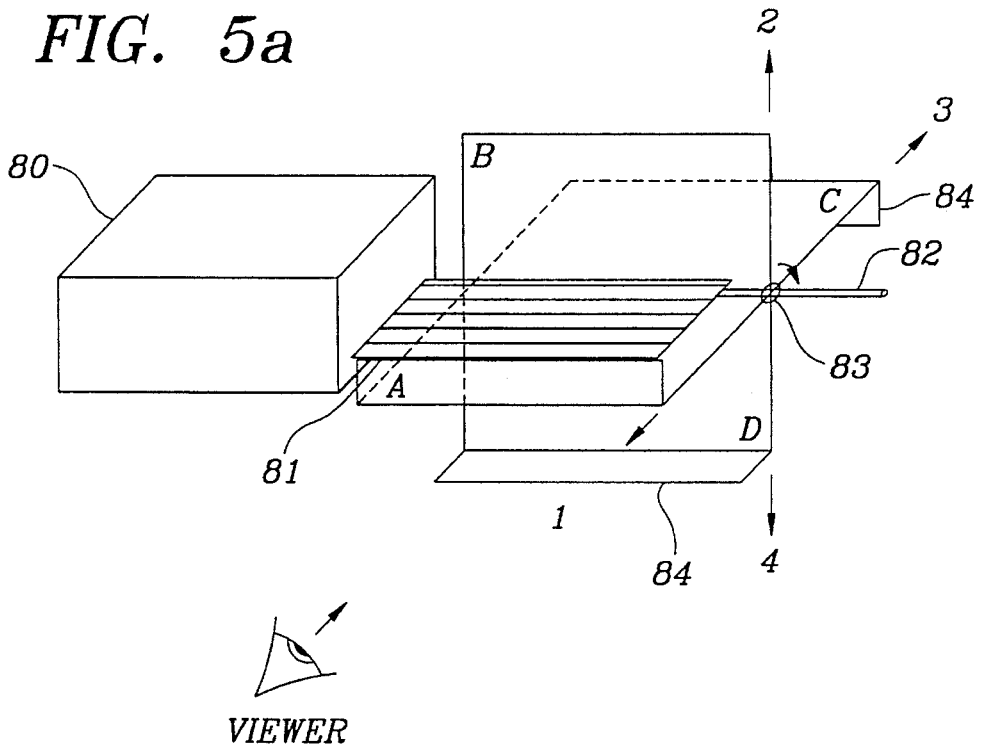
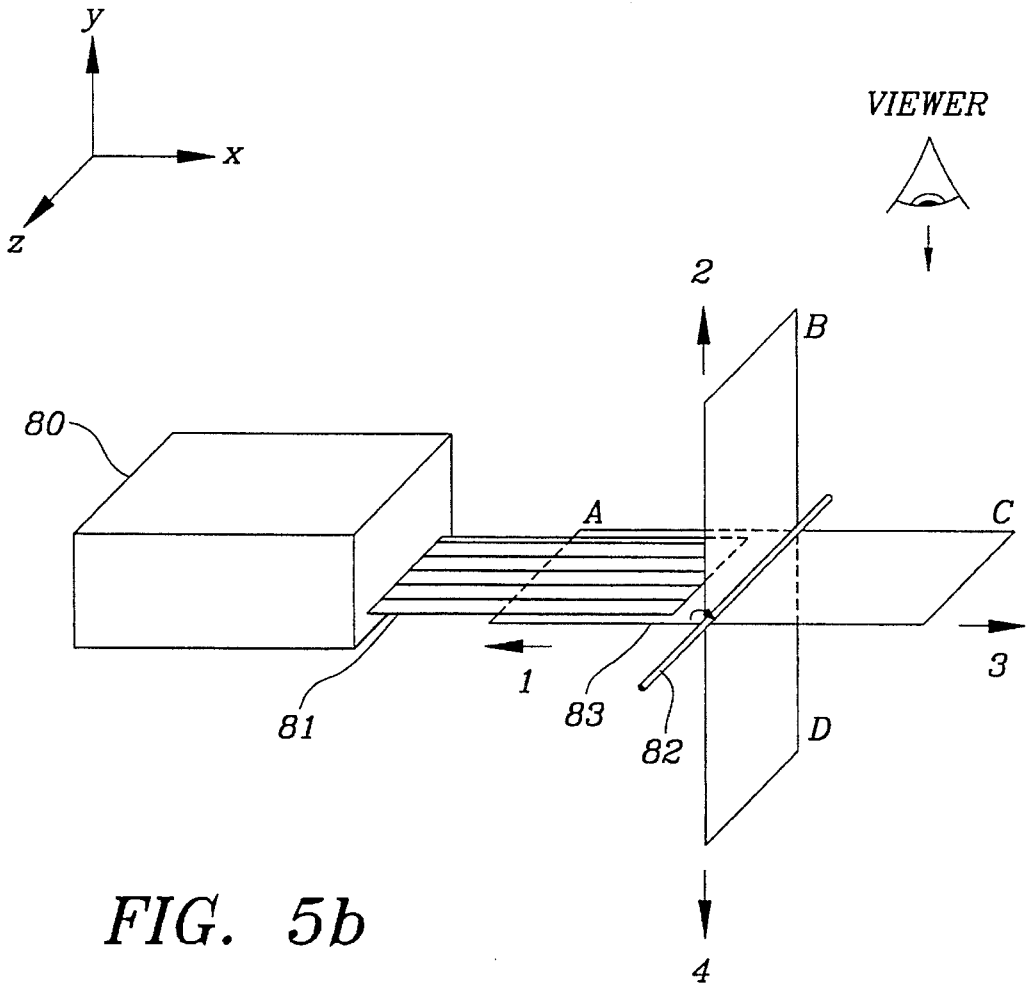
FIG. 5b

ELECTRONIC WAGERING MACHINE

BACKGROUND OF THE INVENTION

1. Field of the Invention

The instant invention relates to electronic wagering machines and a method of use applicable to the simulation of various games of chance such as black jack, poker, keno and lottery.

2. Description of the Prior Art

Legalized wagering has always been a popular diversion for the general public. In recent years, such activities have become increasingly more important to various governmental entities for the generation of revenue. There has long been a demand for tamper-proof coin or token operated gaming devices which permit one or more players to play against the device. These games may be games of pure chance, such as the "slot machine," or they may simulate some well known games of chance and skill such as those played with cards. The conventional state of the art electronic gaming devices provide computerized displays that allow for the selections of the cards and/or numbers that may be involved. None of the prior art, however, furnishes an apparatus to ensure, or a method of ensuring, the integrity of the game being played. The present invention seeks to solve this problem and advance the art by supplying a gaming device that predeals the results so that a player can verify after the game the probity of the gaming device.

A typical device of the prior art comprises an indicating unit having a plurality of selectively operable card indicating devices, one for each of a group of possible cards, and a card memory having a plurality of memory stages. Each indicator device is typically provided with a memory stage. Each memory stage typically has an input and an output connected to the associated indicator device, and is usually operable to assume one of three memory modes: (a) a reception mode; (b) a memory mode; and (c) a blocking mode. Each memory stage operates to produce an output signal when in the memory mode. No output signal is produced when in the reception or blocking modes. Finally, switching to the memory mode in response to a signal on the input is provided if it is in reception mode but not in blocking mode.

The typical prior art device also includes a dealing unit having a plurality of outputs, each connected to the inputs of the respective card memory stage. The dealing unit typically includes a random signal generator to all outputs from the dealing unit, a means for cyclically enabling the outputs form the dealing unit, by which an output signal on one of the output lines is produced if a random signal occurs when one of the output lines is enabled. The output signal operating to switch the card memory is typically connected to one of the output lines while in its memory mode. If the same output line is in its reception mode, a counter circuit connected to the outputs of all of the memory stages operates to produce an output pulse when a predetermined number of memory stages have been switched to their memory conditions.

Also generally included, is a means interconnecting the counter and the random signal generator for inhibiting the further generation of random signals in response to the output signal from the counter indicating that the predetermined number of memory stages have been switched to their memory modes so as to represent that a predetermined number of cards have been dealt. A card return unit is usually employed which has a plurality of operating members, each connected to a respective memory stage. When actuated, the card unit operates to switch the associated memory stage from its memory mode to its blocking mode. A new deal operating member is typically connected to the dealing unit so as to actuate the dealing unit and randomly switch further memory stages to their respective memory modes until the predetermined number of memory stages in the memory mode is re-established.

Further conventional components include a stake unit having a coin or token receiving mechanism as well as means for producing an output signal when coins or tokens are held in the stake unit. Inhibit means typically interconnects the output of the stake unit and the dealing unit and operates to inhibit the dealing unit, unless there is an output from the stake unit. Result read-out means is typically connected to the memory stages to indicate the score obtained in response to the output of any memory stage in memory mode. The stake unit typically comprises a token input and checking device which stores the credit balance and indicates what credit balance can be made up from the amount placed by the player in the form of tokens in the wagering machine and also from the winnings. The machine typically also includes a pay-out unit which enables the player or players to have the credit balance or any part thereof, paid out.

The following U.S. Patents are typical of the prior art and are incorporated herein by reference:

U.S. Pat. No. 5,275,400 to Weingardt et al, teaches a pari-mutuel electronic gaming device designed to comply with both federal and state gaming regulations, including the requirements of the Federal Communications Commission (F.C.C.). The payouts are based on a para-mutuel system much like the system used at horse racing tracks. U.S. Pat. No. 3,876,208 to Wächtler et al, teaches an electronic gaming device designed to simulate the casino type games. This device includes, among other things, a dealing unit, a card return unit and a result read-out unit to indicate the score obtained. U.S. Pat. No. 3,796,433 to Fraley et al, teaches an electronic gaming device designed to simulate the game of black jack or "21." Components of this device include a display panel electrically connected to the computer to show the progress of the game as well as the result.

Although the foregoing references exemplify the advancements which have been made in the art of wagering machines, there nonetheless exists in the art, a long felt need to provide means to substantially preclude cheating or the potential of tampering with the results of any game played on such a machine as well as to eliminate any appearance of impropriety. There further exists a need to design a device, and method of use thereof, that allows the player to take a more active role in the playing of the game.

It is therefore an object of the instant invention to provide improvements in the art of electronic gaming devices which substantially preclude cheating or tampering with game results.

It is a further object of the instant invention to propose a new scheme or game rule applicable not only to all traditional playing card games, but to lotteries as well.

It is yet a further object of the instant invention to provide a method of use that insures the probity of an electronic gaming device.

It is also an object of the instant invention to provide different methods of printing out and/or displaying the results of electronic gaming devices.

It is still another object of the instant invention to provide a more interactive electronic game that allows for more activity by the player.

SUMMARY OF THE INVENTION

The instant invention provides a method and apparatus for employing a micro-processor to simulate a game of chance which includes generating a sequence or array consisting of a finite number of hidden playing cards or numbers, randomizing the sequence, and displaying the sequence in a predetermined arrangement, wherein the improvement broadly includes enabling a player or players to select, and reveal if required, as many of the hidden playing cards or numbers of the arrangement sufficient to enable completion of the game, and wherein all the playing cards or numbers of the arrangement are revealed only after the game is completed by the player or players. The invention contemplates displaying the sequence in one of two alternative ways: (a) displaying the randomized sequence consisting of at least one deck of playing cards (generally fifty-two (52) cards per deck, but the number may vary depending on the game being played) on a monitor screen in an arrangement having "M" rows and "N" columns; or (b) displaying the randomized sequence in a "stack" depicted on the monitor screen, a truer simulation of traditional card games.

The revealing improvement more specifically includes: (a) generating a printout of the revealed entirety of playing cards or numbers; directly thereafter receiving the printout face-down in a locked enclosure; and, opening the enclosure only after the game has been completed; or, (b) generating a printout of the revealed entirety; transferring the printout from the printer to a position under an opaque cover placed within a sealed transparent enclosure; and, displacing the opaque cover from over the printout only after the game is completed; or, (c) the improvement of (a) or (b) in which the printout is a long, narrow paper tape upon which each element of the entirety is printed in sequence; or, (d) providing at least one video monitor for displaying the predetermined arrangement before the game is begun; and providing means for disclosing the entirety only after the game has been completed.

The advantages and objects of the instant invention will become evident by referring to the following description and claims taken in conjunction with the accompanying drawings.

BRIEF DESCRIPTION OF THE DRAWINGS

FIGS. 5*a* and 5*b* show, respectively, two different setups for displaying and printing the results of a game.

DETAILED DESCRIPTION OF THE PREFERRED EMBODIMENTS

Figure 1A:
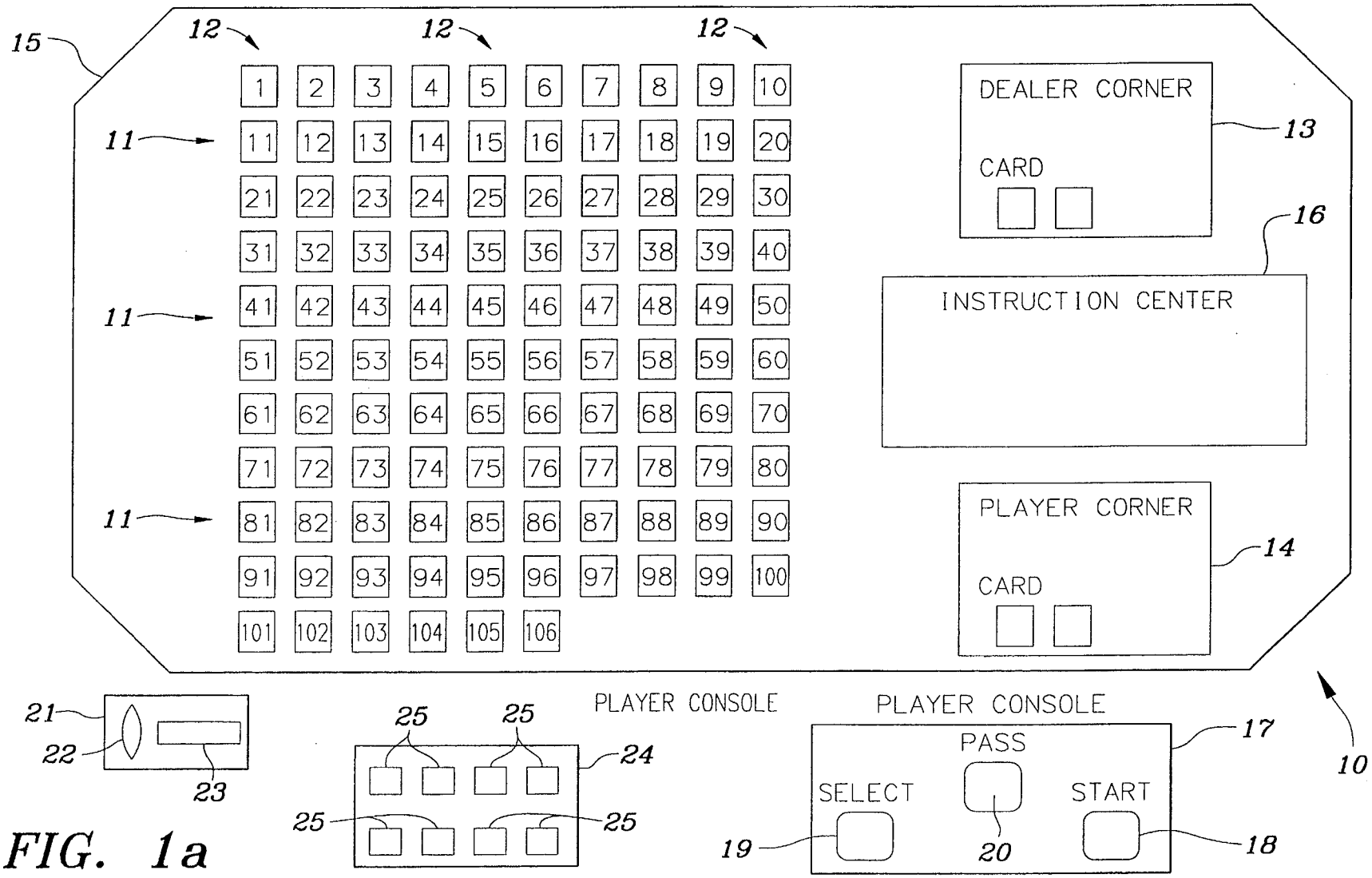
FIG. 1*a* shows a display which enables a single player to play a card game such as black jack, poker or keno.

Referring now to the drawings, FIG. 1*a* shows a first embodiment 10 of the invention, wherein two complete sets of randomized playing cards are depicted on a monitor screen in eleven (11) rows 11 and ten (10) columns 12. The dealer's hand 13 is displayed in the upper right hand corner of the monitor 15, and the player's hand 14 is displayed at the lower right hand corner. An area 16 midway between the two hands is reserved for displaying instructions for the specific game to be played. A stake unit 21 is provided which has an opening 22 in which the player inserts a coin, token, bill or magnetic card to activate the device. Alternatively, the stake unit 21 includes a keyboard 23 and the player activates the device by typing a pregiven code on the keyboard 23. A remote player console 17 is provided for the player's input into the game, through control buttons labeled "START," 18 "SELECT," 19 and "PASS" 20. When depressed, the START 18 button initiates the beginning of the game. The microprocessor (or computer) generates and randomizes the sequence of playing cards and depicts them as an arrangement of hidden images on the monitor screen, and causes a hidden printout of the true revealed values of the arrangement to be generated, but which can be accessed by the player only after the game has been completed.

Once the game begins, the microprocessor thereupon generates indicia which cues the player to select a card. This can be done, for example, through the display of written text in the instruction center area 16 on the monitor 15 or by flashing a card in the player's corner 14 of the screen. The player is thereby prompted to select, and at the same time reveal, a card by touching one of the hidden images in the arrangement on the monitor screen 15 while simultaneously depressing the SELECT 19 button for selection confirmation. Alternatively, the player may depress the PASS 20 button as his stratagem and the particular game which was selected may dictate.

Depending on the particular type of game of being played, the player may have the option or be required to make a certain type of selection. Such selections are provided for in a remote player console 24 having a plurality of keys 25 identified by terms such as "HIT", "STAY", "DEAL", "BET", "PAYOUT", "INSURANCE", "SURRENDER", "DOUBLE UP", "SPLIT", "GAME OVER" and the like. The terms may be permanently encrypted or temporarily stored by electronic means.

Rather than using rows 11 and columns 12, the randomized sequence can be depicted on the monitor screen as a stacked deck, as in a traditional game. In this case the microprocessor assigns each of the cards of the randomized sequence a consecutive number from the linear progression starting with 1, 2, 3 . . . n, and thereafter prints out the contents of the assigned sequence before the game is started. Since the cards are revealed to the player or players and the dealer in a predetermined randomized sequence, the game rules can be the same as those of traditional card games, or can be modified to allow any one player to skip or pick cards for other players and/or the dealer.

EXAMPLE 1

BLACK JACK OR "21" FOR ONE PLAYER

In reference to FIG. 1*a*, the foregoing row and column arrangement is more specifically illustrated by the following sequence of steps to play black jack or "21":

Step 1—The player inserts a token or coin or inputs a code into the stake unit 21 of the device and presses "START" 18 to start the game.

Step 2—The computer randomizes the sequence of playing cards and displays them in hidden form in the predetermined arrangement of rows 11 and columns 12 on the monitor screen.

Step 3—The computer provides a hidden printout of the revealed predetermined arrangement and deposits it in a sealed compartment, which can be accessed only after the game has been completed.

Step 4—The player selects a card for himself from the player's corner 14 which is revealed.

Step 5—The player selects a card for the dealer from the dealer's corner 13 which is not revealed.

Step 6—The player selects a card for himself from the player's corner 14 which is revealed.

Step 7—The player selects a card for the dealer from the dealer's corner which is revealed.

Step 8—The procedure of Steps 6 and 7 is repeated until the summation of the points of all cards in the player's hand exceeds twenty-one (21) or the player presses the PASS 20 button. A face card counts for ten (10) points, an ace counts optionally for either one (1) or eleven (11) points, and all other cards count for their own numerical value.

Step 9—If the player's hand has not exceeded twenty-one points from Step 8, he then reveals the dealer's card which was selected in Step 5, and selects and reveals another card for the dealer from the dealer's corner 13. Alternatively, if the player has exceeded twenty-one points (the player "breaks"), he has lost the game. The game is over and may be optionally restarted.

Step 10—If the dealer's hand has not beaten the player's hand, the player selects and reveals another card for the dealer from the dealer's corner 13.

Step 11—The player repeats Step 10 until the dealer's hand beats his hand or until the dealer's hand exceeds twenty-one points (the dealer "breaks").

Step 12—If the dealer's hand exceeds twenty-one points (the dealer "breaks"), the player has won, and the machine must pay out to the player. Alternatively, if the total of the points in the dealer's hand is equal to or greater than the total of the points in the player's hand, and is equal to or less than twenty-one points, then the player has lost. The game is over and may be optionally restarted. Optionally, in the situation where the total points in the dealer's hand and the total points in the player's hand are both the same (the player "ties" the dealer), and where neither player nor computer "breaks", the player's wager can be refunded (the player "pushes").

Figure 1B:
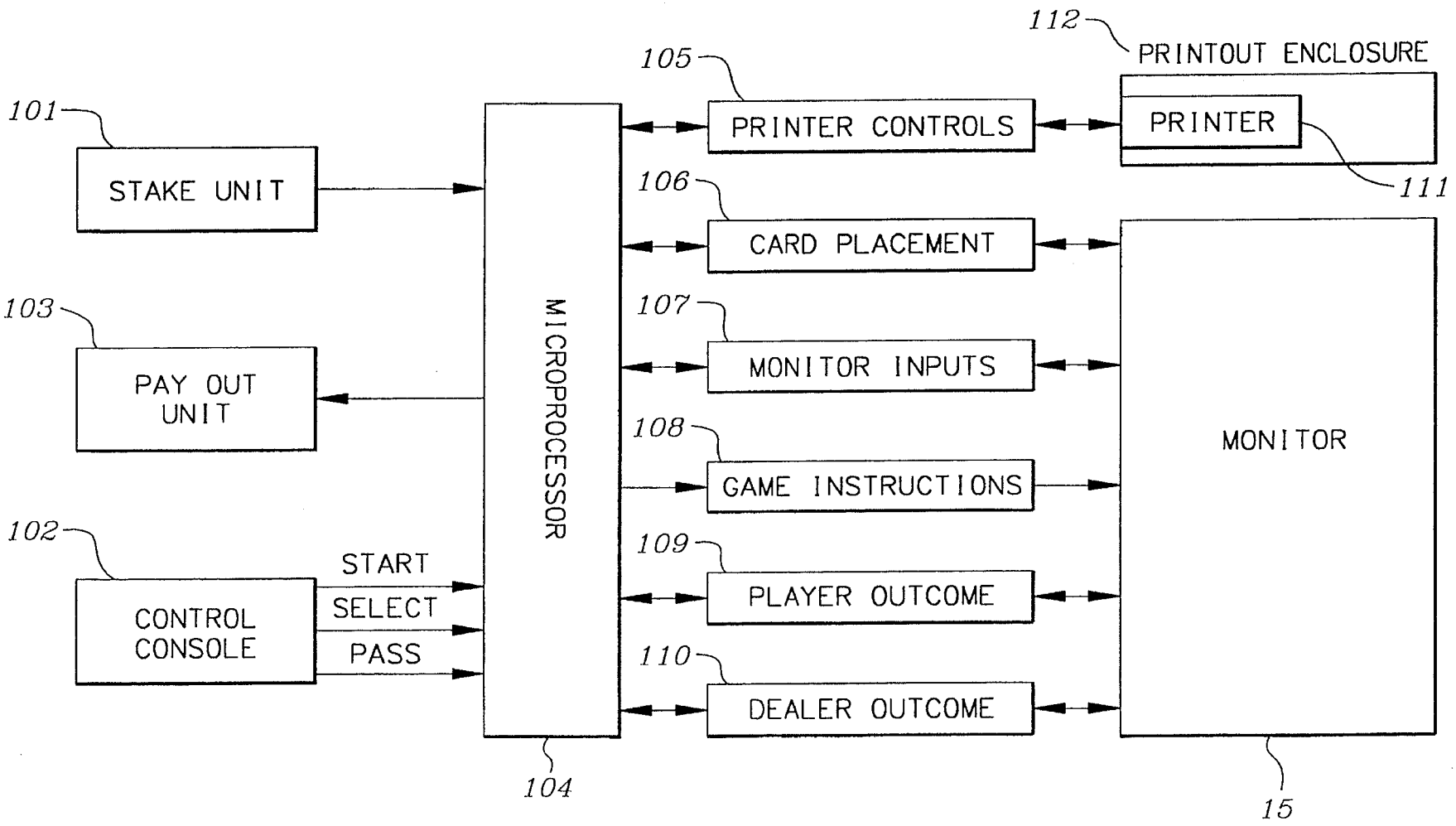
FIG. 1*b* shows a flow chart of all the components of the circuit of FIG. 1*a*, which identifies each electronic component and specifies the value thereof where applicable.

The electronic components of FIG. 1*a* are laid out in the flow chart of FIG. 1*b*. The stake unit 101 allows the player to insert a coin, bill, token, or magnetic account card to initiate a game. The control console 102 generates three control signals "START", "SELECT", "PASS", which are sent to the microprocessor 104 unit. The Payout unit 103 delivers tokens or updates the magnetic card for credit according to the outcome of the game. The microprocessor 104 unit is the central processing unit (CPU) for game rules, video display formats and print-out controls. Computer software is stored in this unit to direct the game. The "printer control" 105 block loads card placement information for the printer and controls printout enclosure equipments. The "card placement" 106 block loads the unrevealed card placement information to the central monitor screen through a video driver unit. The "monitor inputs" 107 block receives the selected card signal generated through "touching the screen" and then updates the screen display. The "game instructions" 108 block provides game instructions and prompts the player to respond. The "player outcome" 109 and "dealer outcome" 110 blocks provide card information which is displayed on the screen during the game for the player and the dealer, respectively. The monitor 15, printer 111 and printout enclosure 112 are activated by the commands issued by the electronic components.

Figure 2A:
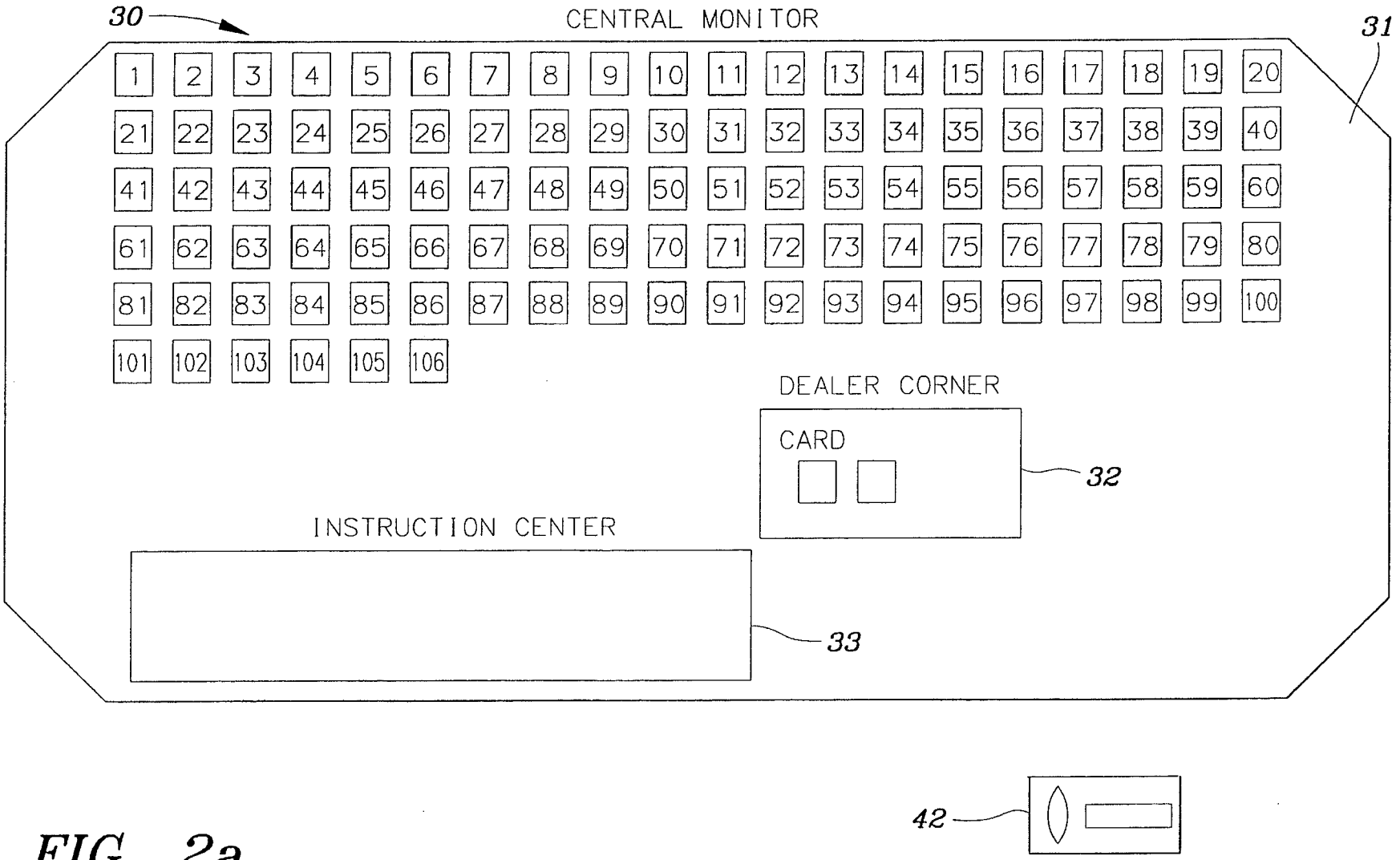
FIG. 2*a*–2*c* show a central control monitor display and multiple player monitor displays, which enable a plurality of players to play a card game such as black jack, poker or keno.
Figure 2B:
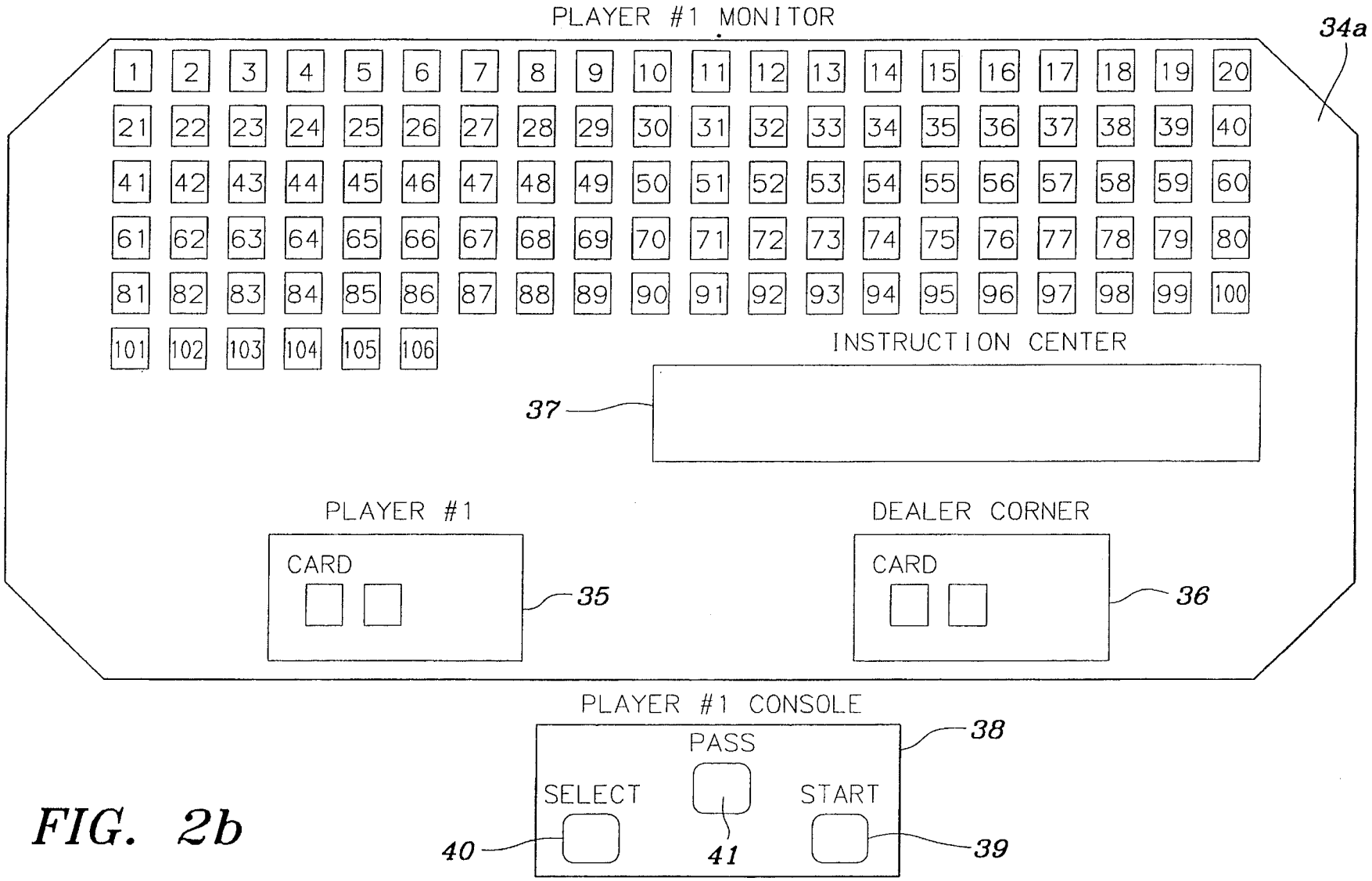
Figure 2C:
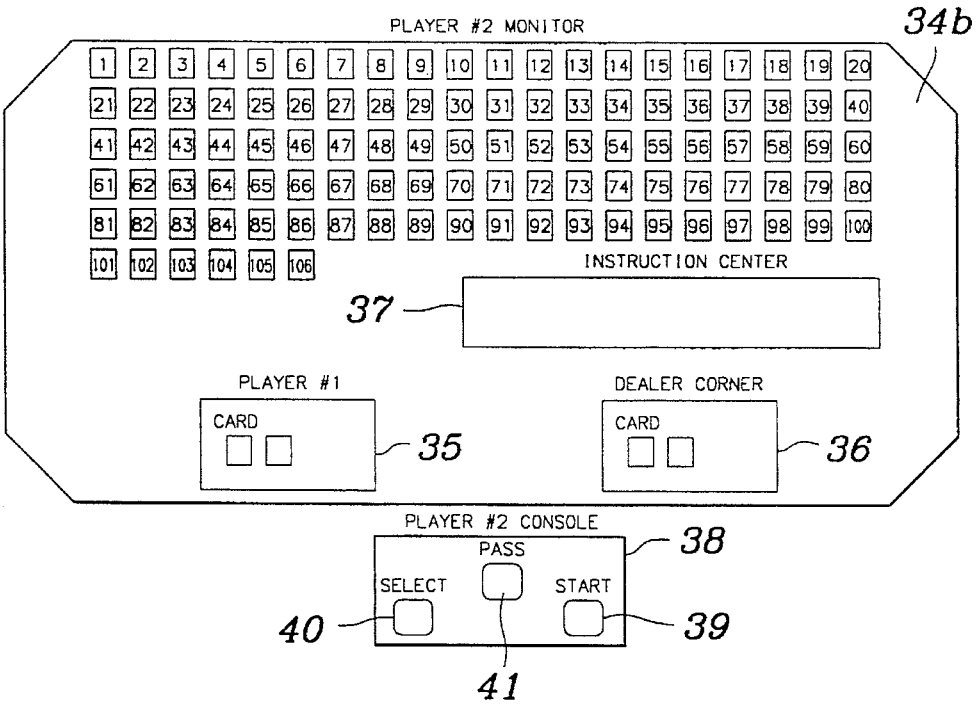
Figure 2C:
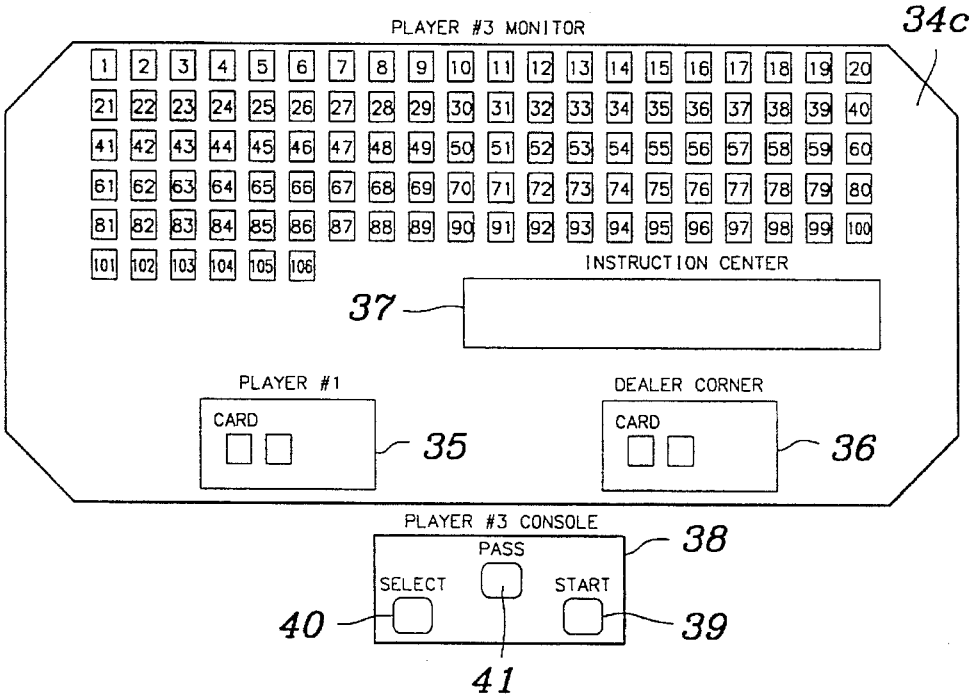

Another embodiment 30 illustrates how the instant invention can be applied to a plurality of players. FIGS. 2*a*–2*c* specifically illustrate the manner in which the instant invention is applicable to card games which accommodate three (3) players. In FIG. 2*a*, a central control monitor 31 is provided for displaying the randomized hidden sequence of playing cards in a predetermined arrangement of rows and columns, the dealer's hand 32 as it develops, and the game instructions 33. In FIGS. 2*b* and 2*c*, a separate monitor 34*a*, 34*b* and 34*c* is provided for each player for displaying the player's 35 and dealer's 36 hands as they develop, and game instructions 37. Each player's monitor 34*a*, 34*b* and 34*c* is also provided with a separate remote control console 38 having START 39, SELECT 40 and PASS 41 buttons for playing the game.

EXAMPLE 2

BLACK JACK OR "21" FOR THREE PLAYERS

In reference to FIGS. 2*a*–2*c*, the foregoing row and column arrangement as applied to three (3) players is more specifically illustrated by the following sequence of steps to play black jack or "21":

Step 1: Each player inserts a coin or token, or inputs a code into the stake unit 42 of the device and presses "START" to activate the game and randomize the predetermined arrangement of hidden playing cards on each of the player's separate monitors 34*a*, 34*b* and 34*c*.

Step 2: The computer instructs the first player to select a card, which is thereupon revealed on the monitor screen 34*a* of the first player.

Step 3: The computer instructs the second player to select a card, which is thereupon revealed on the monitor screen 34*b* of the second player.

Step 4: The computer instructs the third player to select a card, which is thereupon revealed on the monitor screen 34*c* of the third player.

Step 5: The computer instructs the first player to select a card for the dealer, which is thereupon displayed in its hidden form in the dealer's corner 32 and 36 of all monitor screens 31, 34*a*, 34*b* and 34*c*.

Step 6: The computer instructs the first player to select a card, which is thereupon revealed on the monitor screen 34*a* of the first player.

Step 7: The computer instructs the second player to select a card, which is thereupon revealed on the monitor screen 34*b* of the second player.

Step 8: The computer instructs the third player to select a card, which is thereupon revealed on the monitor screen 34*c* of the third player.

Step 9: Steps 6 to 8 are repeated for each player until he has either pressed the PASS 41 button, or the total of the points of his hand exceeds twenty-one (21) (the player "breaks"), whereby that player has lost and is no longer in the game.

Step 10: The computer instructs the second player to select a second card for the dealer which is displayed in its revealed form in the dealer's corner 32 and 36 of all monitor screens 31, 34*a*, 34*b* and 34*c*.

Step 11: The computer instructs the third player to reveal the dealer's first card indicated in Step 5 and to select a third card for the dealer if so determined by the computer.

Step 12: The computer directs that step 11 be repeated by the next player remaining in the game, until: (a) it decides to stand on a hand having a point total under twenty-one (21), or (b) the hand exceeds a point total of twenty-one (the dealer "breaks").

Step 13: If (a) of Step 12 occurs, then the dealer pays out to any player having a point total under twenty-one (21) and higher than the dealer's point total; if (b) of Step 12 occurs, then the dealer pays out to all players remaining in the game. Optionally, like in Example 1 above, if a player ties the dealer without "breaking", the player's wager may be refunded (the player "pushes").

In the arrangement depicted in FIG. 2*a*, the central monitor 31 for the dealer can be made larger to facilitate viewing by all players. At the bottom of each individual player's monitor 34*a*, 34*b* and 34*c*, the two regions for displaying the player's hand 35 and the dealer's hand 36 are equipped with electronic lighting capabilities. A flashing card indicia at either region prompts a player to select a card for himself or the dealer. A flashing card in the region on the first player's screen 34*a*, for example, prompts the first player to make a card selection. A flashing card and a flashing player's number in the dealer's region 32 and 36 prompts that player to make a card selection for the dealer. In both of the disclosed single and plural player arrangements illustrated by FIGS. 1*a* and 2*a*, the selected card will be moved from the dealer's screen 13 and 32 to the player 14 and 35 or dealer 36 region of the player's screen 15 or the players' screens 34*a*, 34*b* and 34*c* after any one of the individual SELECT 40 buttons has been depressed by a player.

Figure 2D:
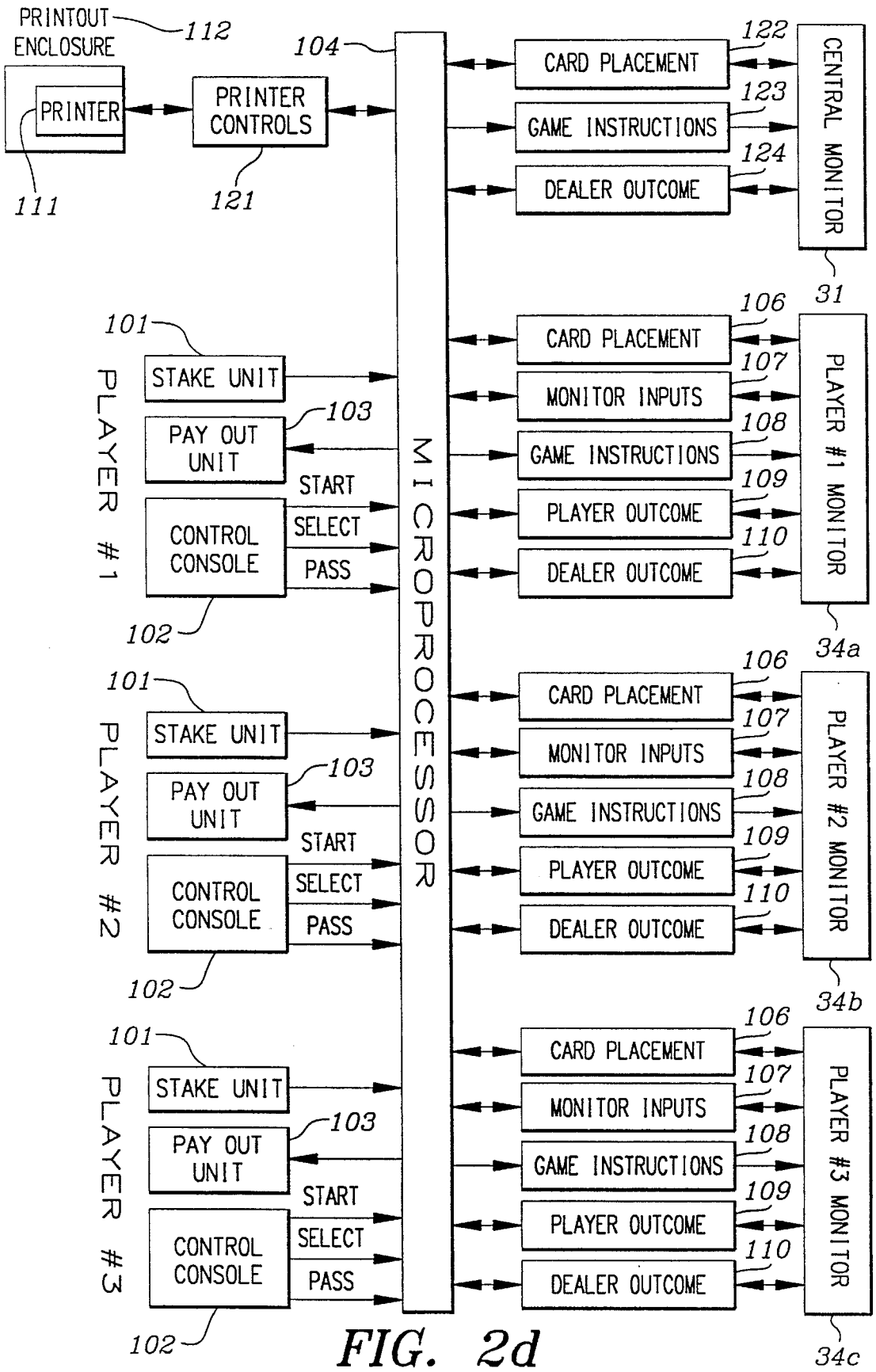
FIG. 2*d* shows a flow chart of all the components of the circuits of FIGS. 2*a*–2*c*, which identifies each component and specifies the value thereof where applicable.

The electronic components of FIGS. 2*a*–2*c* are laid out in the flow chart of FIG. 2*d*. This figure shows the block diagrams for three (3) players 34*a*, 34*b* and 34*c* and the central monitor 31. It includes three (3) duplicate block diagrams similar to those shown in FIG. 1(*b*). The similarities include the stake unit 101, control console 102, payout unit 103, microprocessor 104, card placement 106, monitor inputs 107, game instructions 108, player outcome 109, dealer outcome 110, printer 111 and printout enclosure 112. The differences include that there is only one "PRINTER CONTROL" 121 unit and one printer setup. Furthermore, there is an additional central monitor 31 unit connected to blocks for "CARD PLACEMENT", 122 "GAME INSTRUCTIONS", 123 and "DEALER OUTCOME" 124.

EXAMPLE 3

APPLICATION TO POKER

The instant invention can be applied to the game of draw poker. In the variant providing a predetermined arrangement of hidden playing cards displayed on the screen, a player first selects five (5) cards from the screen. The player then discards up to the maximum number of cards allowed (usually three (3) cards, but may be four (4) cards if the player holds and keeps an ace) and makes a final selection of cards to replace those discarded. The computer and player determine the dealer's hand. The player selects five (5) cards from the screen for the dealer. The computer determines to discard certain cards and instructs the player to select additional cards for the dealer. The computer then calculates the score for the players final hand, the score for the dealer's final hand and whether or not the player's score warrants a payout.

Figure 3A:
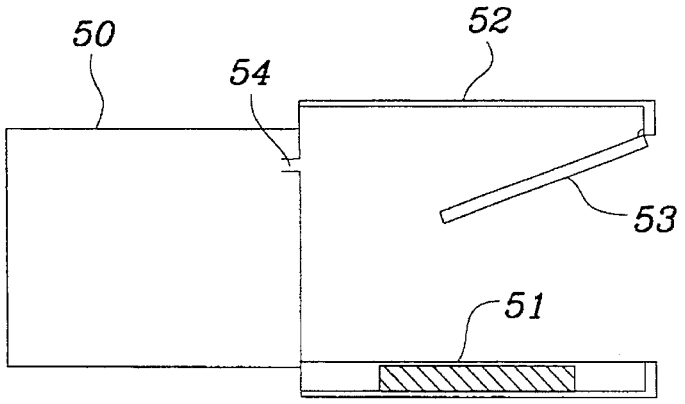
FIGS. 3*a* and 3*b* show, respectively, plane and elevation views of one variant of the novel means for enabling a player or players to view a record comprising a print-out of the starting sequence of revealed cards or numbers printed prior to play, but only after the game has been completed.
Figure 3B:
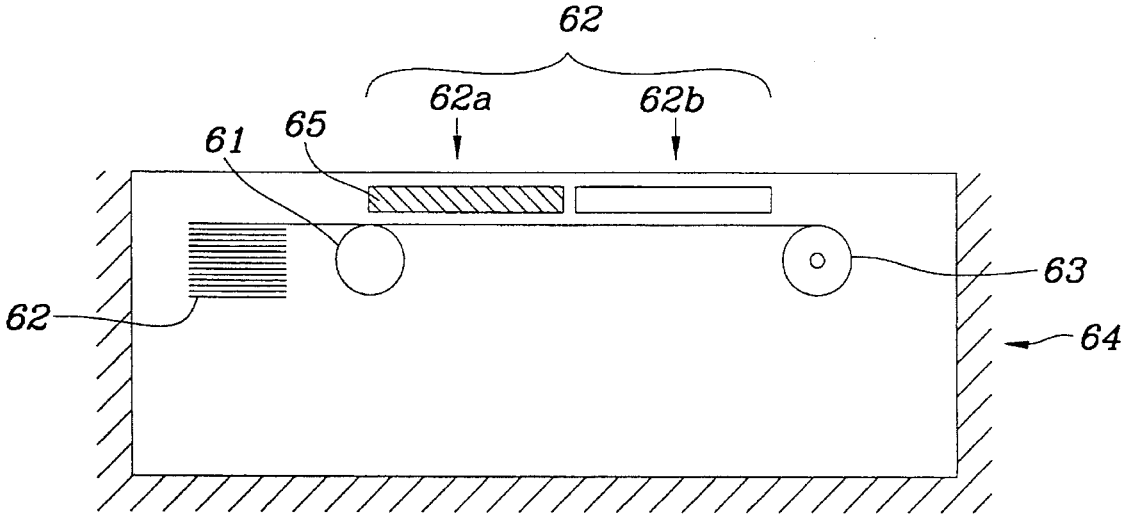

FIGS. 3*a* and 3*b* show an aspect of the instant invention which essentially precludes the potential of cheating or tampering with the results of any given game. The instant invention provides for a hidden printout of the initial prearrangement of the revealed cards or numbers, to which the player or players may gain access only after the game has been completed. Four variants are contemplated.

In accordance with the first variant, and illustrated by FIG. 3*a*, a hidden printout of the initial prearrangement of cards or numbers is generated by the computer through a printer 50. The hidden printout goes through a paper carrier means 54 and is thereupon deposited face down 51 in a locked transparent compartment 52. The compartment door 53 can be automatically opened only after completion of the game, or optionally after a "GAME OVER" button (not shown) is depressed. Thus, before the completion of the game, the players can see that the printout has been issued, but they cannot read it.

In a second variant, and illustrated by FIG. 3*b*, a hidden printout generated by the computer through a printer 60 is rolled or sent from the printer 60 to a position 62*a* underneath a movable opaque cover 65 which is located within a sealed, transparent enclosure 62. The transparent enclosure 62 is divided into two (2) compartments 62*a* and 62*b*. The opaque cover 65 can be caused to move from a first position 62*a* over the top of the printout to a second position 62*b* next to the printout, which enables the players to view the printout, but only after the completion of the game. Before a new game is initiated the opaque cover 65 is caused to move back to the first position 62*a*, by for example, a "RESET" button (not shown). Also provided is a paper file holder 63 and a paper roller 63. All the components may be enclosed in one box 64.

According to a third variant, the revealed cards or numbers of the randomized prearrangement is sequentially printed on paper tape, for example, ticker tape. In the case of the stacked deck embodiment, the sequence counting from the top card to the bottom card of the stacked deck is printed in sequence on the tape. In the case of the row and column embodiment, the revealed cards or numbers are printed sequentially on the tape, row by row or column by column. As illustrated in the first variant, the tape printout is dropped, face down, in a sealed compartment before play is initiated.

Figure 3C:
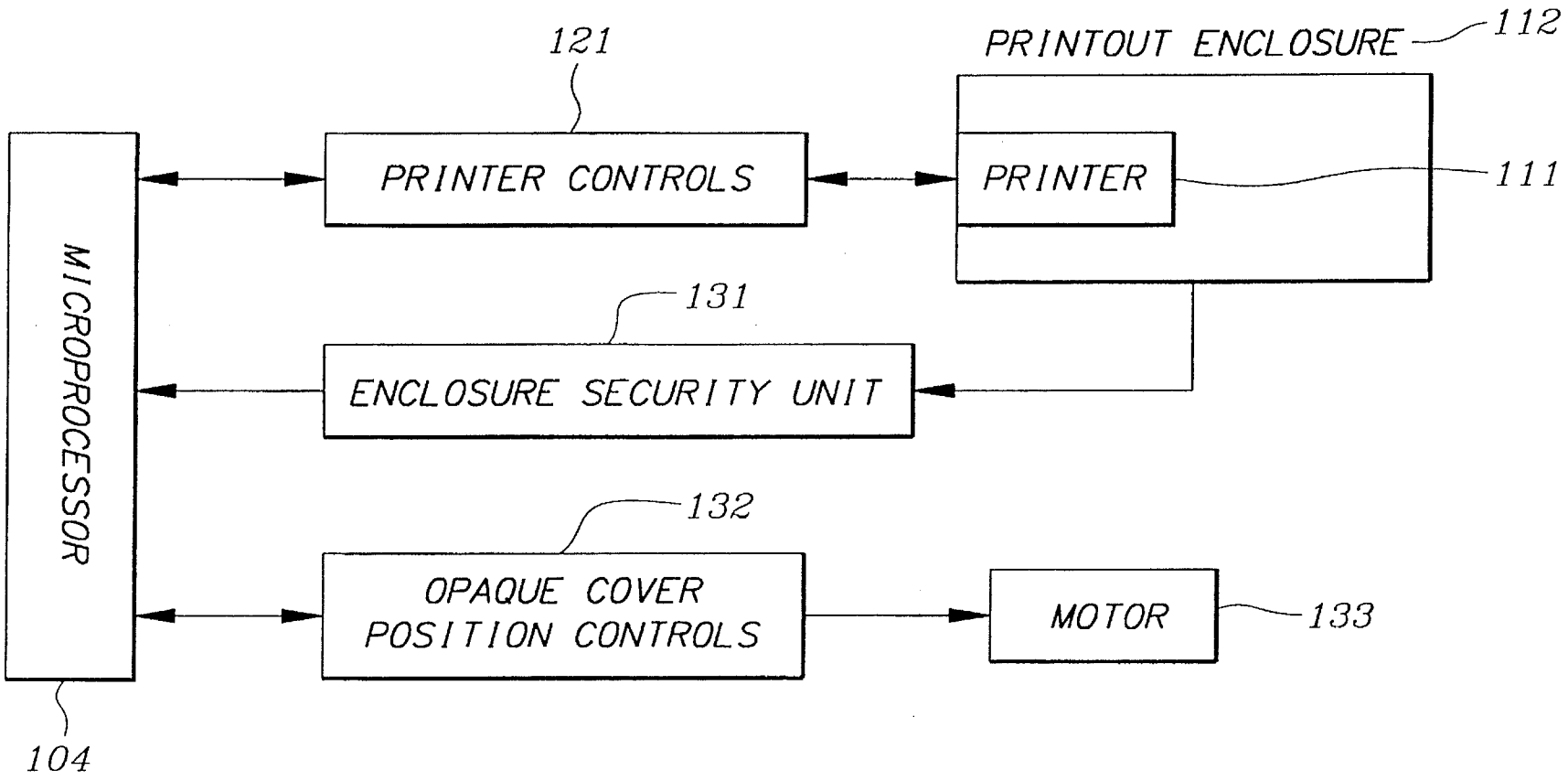
FIG. 3*c* shows a flow chart of all the components of the circuits of FIG. 3*a* and 3*b*, which identifies each component and specifies the value thereof where applicable.

The electronic components of FIGS. 3*a* and 3*b* are laid out in the flow chart of FIG. 3*c*. This figure shows the block diagram of the printout system. The microprocessor 104 unit generates and processes data and control signals for the "PRINTER CONTROLS" 121 unit, "ENCLOSURE SECURITY UNIT" 131, and the "OPAQUE COVER POSITION CONTROLS" 132. The "PRINTER CONTROLS" 121 block provides data for the printer to print out. The "ENCLOSURE SECURITY UNIT" 131 block detects a signal if the printout enclosure is intruded or a break-in occurs during a game. The "OPAQUE COVER POSITION CONTROLS" 132 block controls a motor 133 to change the opaque cover position.

Figure 4A:
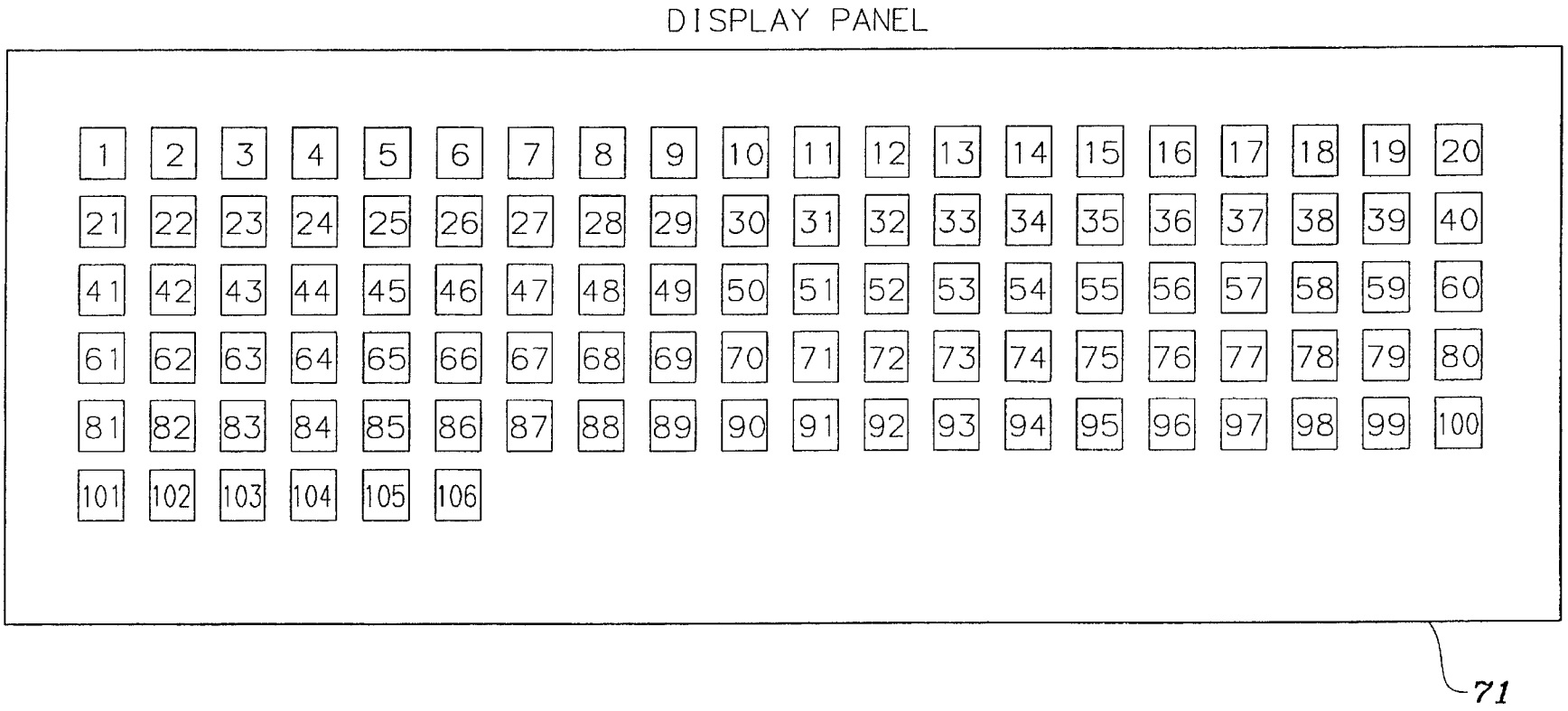
FIGS. 4*a* and 4*b* show, respectively, a display panel and control monitor, which together provide a variant for enabling a player or players to view a preserved record of the starting sequence of cards or numbers, but only after the game has been completed.
Figure 4B:
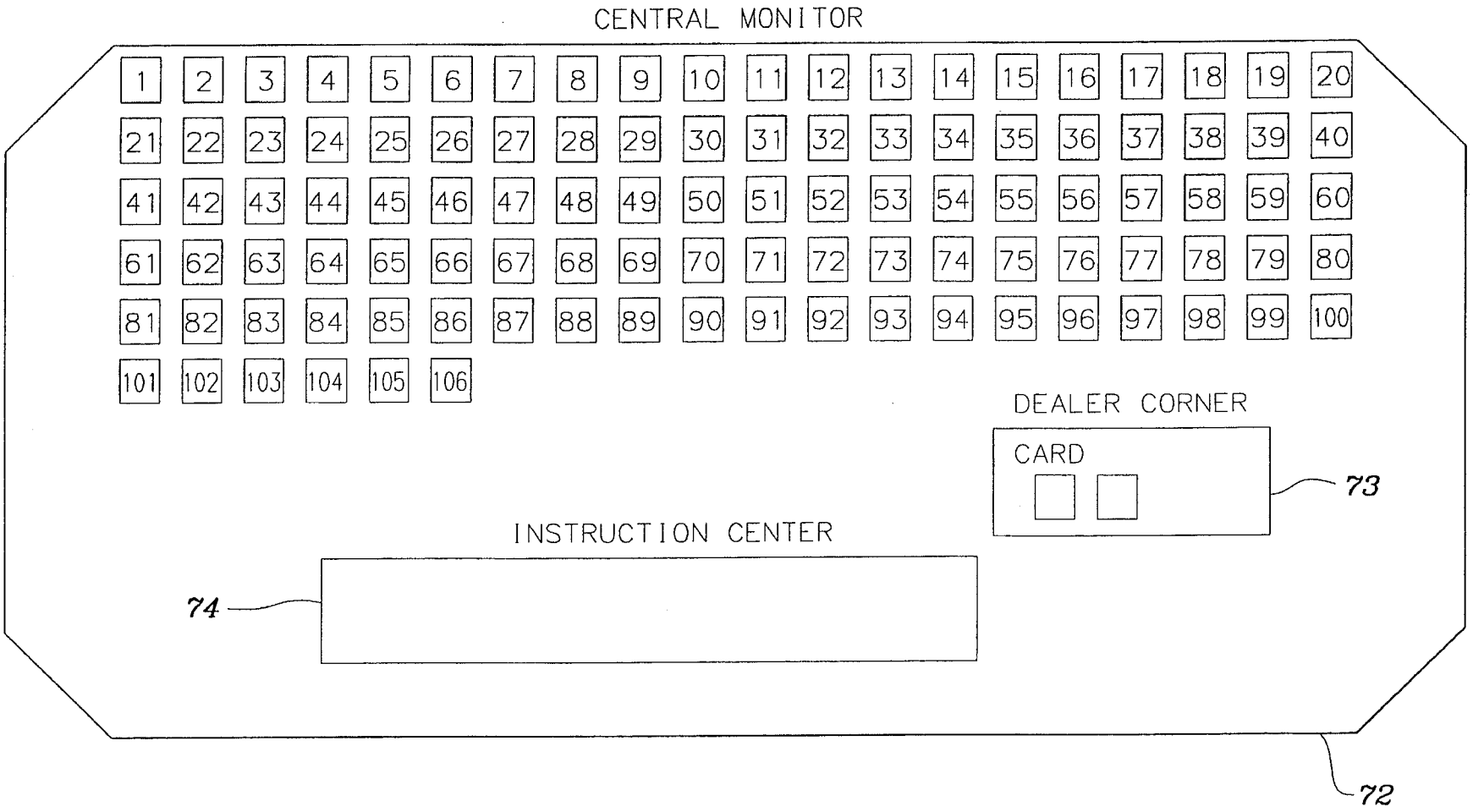

As an alternative to a printout, a fourth variant of the invention is illustrated in FIGS. 4*a* and 4*b*. This embodiment provides a display panel 71 and a control monitor 72. Each screen 71 and 72 has a corresponding position for each of the cards or numbers of the randomized prearrangement. Before play is initiated, each card or number of the randomized prearrangement is reproduced in its corresponding position on the screen, either through mechanical means such as a card rotating machine or through electronic means similar to that previously disclosed. Each screen 71 and 72 is loaded with card information at the beginning of a game, which is held during a game until a new set of cards is displayed again for the next hand. During the game, the real cards are masked out so that the player is not able to view their contents. The real cards are disclosed to the player after the game is over or the "GAME OVER" button (not shown) is selected. Additionally, the central monitor 72 includes the dealer's hand 73 and the instruction center box 74.

Figure 4C:
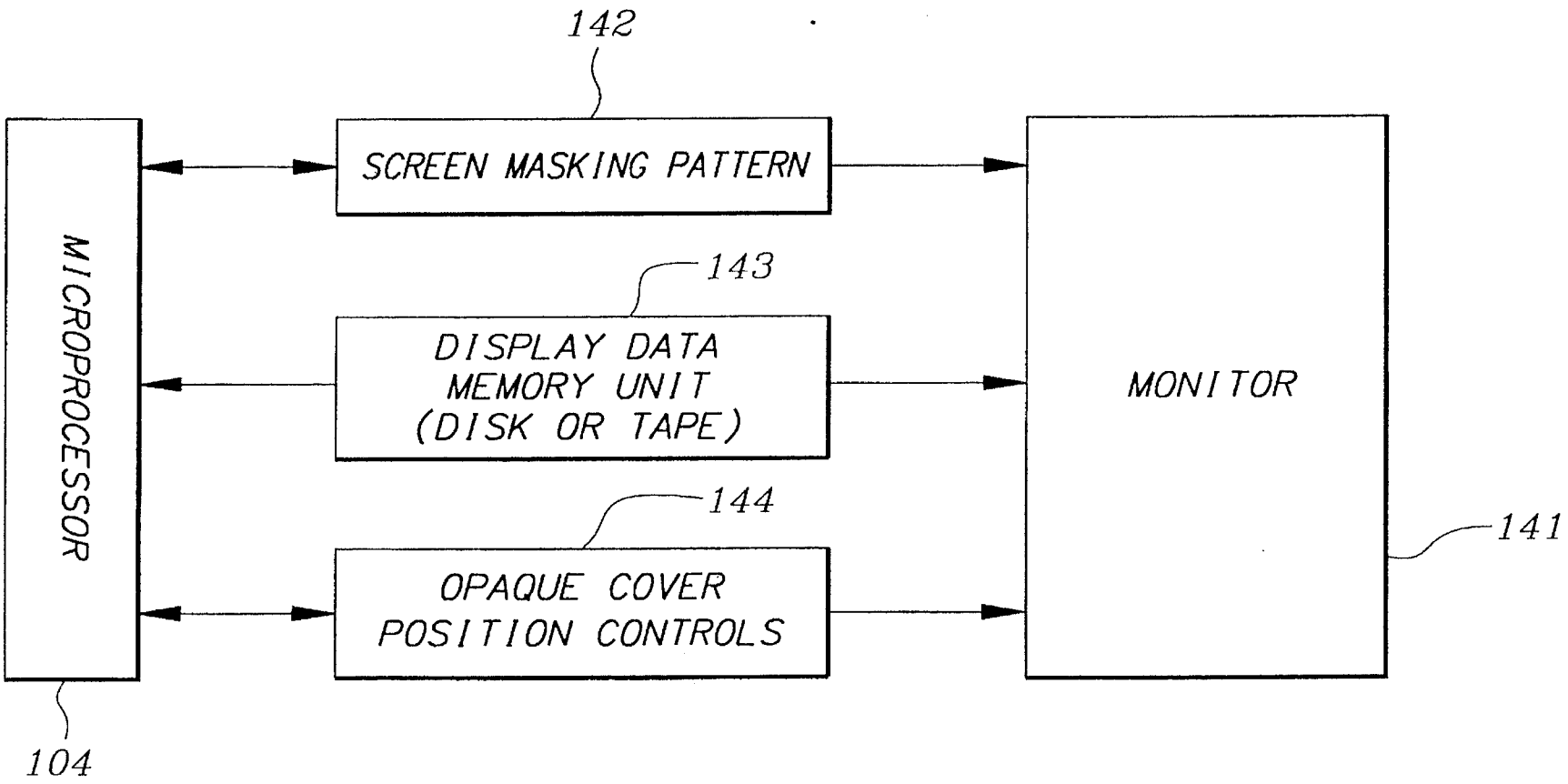
FIG. 4*c* shows a flow chart of all the components of the circuits of FIGS. 4*a* and 4*b*, which identifies each component and specifies the value thereof where applicable.

The electronic components of FIGS. 4*a* and 4*b* are laid out in the flow chart of FIG. 4*c*. Instead of using a printer, this figure shows a block diagram of using a monitor 141 screen to display the card placement after a game. The microprocessor 104 provides a masking pattern to the "SCREEN MASKING PATTERN" 142 block so that the card values are masked during the game. The real card values are loaded and stored ill the "DISPLAY DATA MEMORY UNIT" 143 block using a tape or disk. The "DISPLAY CONTROL" 144 block generates a signal to update the monitor display content.

Potential display method and printing setups are illustrated in FIGS. 5*a* and 5*b*. Each setup includes a printer 80, paper 81 rotor 82 and step motor 83. The step motor 83 controls the rotating position of the rotor 82 which rotates incrementally a quarter turn at a time. In FIG. 5*a*, the rotor 82 rotates in a direction transverse to the printer paper 81. In contrast, FIG. 5*b* shows the rotor 82 rotating in the same direction as the printer paper 81. The rotor 82 has four platforms (A, B, C, and D) connected to its axis. When the paper 81 comes out of the printer 80, it falls on one of the four platforms (A, B, C or D) of the rotor 82. The print out: contains card placements from the screen. In order to conceal the printout from the player during a game, the paper 81 falls on the platform A, B, C or D with its face downward. In one version of the instant invention, the paper 81 may be attached to platform A by a clip 84. See Example 4 and FIG. 5*a*. Alternatively, platform B may fall on top of platform A to hold the paper 81 at position number 1 during a game. See Example 5 and FIG. 5*b*. The display and printing operation varies in accordance with the particular method used to hold the printout paper.

EXAMPLE 4

USING CLIPS TO HOLD PAPER ON A PLATFORM

Referring to FIG. 5*a*, the platforms A and C are shown extending into the x-z plane and the B and D platforms are shown extending into the x-y plane. The platforms rotate 90° at a time. Each platform has a clip 84. The paper 81 comes out of the printer 80 forming a printout which falls on platform A (or C). A clip 84 on platform A holds the printout on the platform. After several games, the cards are shuffled and the card placements on the screens are updated. The rotor 82 turns platform A (or C) to position number 2 so that the players can see the printout of the screen card placement for previous games. The printout on platform A (or C) will remain at position number 2 for players to inspect and verify during the whole period of the next new games. Meanwhile, platform D (or B) is at position number 1, ready to receive more paper 81 from the printer 80.

After several games, the cards are reshuffled and the card placements on the screens are updated. The rotor 82 then turns platform D (or B), which holds a new printout, to position number 2 and platform A (or C) to position number 3. Platform C (or A) is turned to position number 1 ready to receive a another printout of the card placement for the next game. At this time, players can view the printout on platform B (or D). The printout on platform A (or C) from the previous games drops into a trash bucket (not shown) when platform reaches position number 4.

This process repeats itself, to rotating the platforms and displaying the printout to players. In this embodiment, the platforms A, B, C and D are all clear, transparent plates.

EXAMPLE 5

USING PLATFORM B (OR D) TO HOLD PAPER ON PLATFORM A (OR C)

Referring to FIG. 5*b*, the platforms A and C are shown extending into the x-z plane and the B and D platforms are shown extending into the y-z plane. The platforms rotate 90° at a time. The paper 81 comes out of the printer 80 forming a printout which falls on platform A (or C). Platform B (or D) then falls on top of platform A (or C) to hold the printout. After several games, the cards are shuffled and the card placements on the screens are updated. The rotor 82 turns platforms A (or C) and B (or D) to position number 2 so that the players can see the printout of the screen card placement for previous games. The printout on platforms A (or C) and B (or D) remains at position number 2 for players to inspect and verify, until a new game signal is initiated by players.

When a new game signal is initiated, the rotor 82 turns platform A (or C) to position number 3 and platform C (or A) is turned to position number 1, ready to receive a new printout of the card placement for the new game. Platform B (or D) remains at position number 2 and platform D (or B) remains at position number 4. After several games are over, the cards are reshuffled and the rotor 82 turns platform A (or C) to position number 4 and the old printout drops into a trash bucket (not shown). Platform C (or A) is then turned to position number 2 so that the players can view the next printout for verification.

For the next new game, platform A (or C) moves to position number 1 and is ready to receive a new printout. This procedure repeats itself following each subsequent game. In this embodiment, platforms B and D can be dark, opaque color plates, while platforms A and C can be clear, transparent plates. Consequently, when the printout sits on platform A (or C), the players may inspect its contents. But, when platform B (or D) falls on top of platform A (or C) to hold the printout facedown at position number 1, the player is not able to peek through the backside of the paper 81 to see the printout. Nor is the player able to peek underneath the platform. The player must wait until the game is over to view the results when the platforms A (or C) and B (or D) are moved to position number 2 to allow inspection through the transparent A (or C) platform.

Figure 5C:
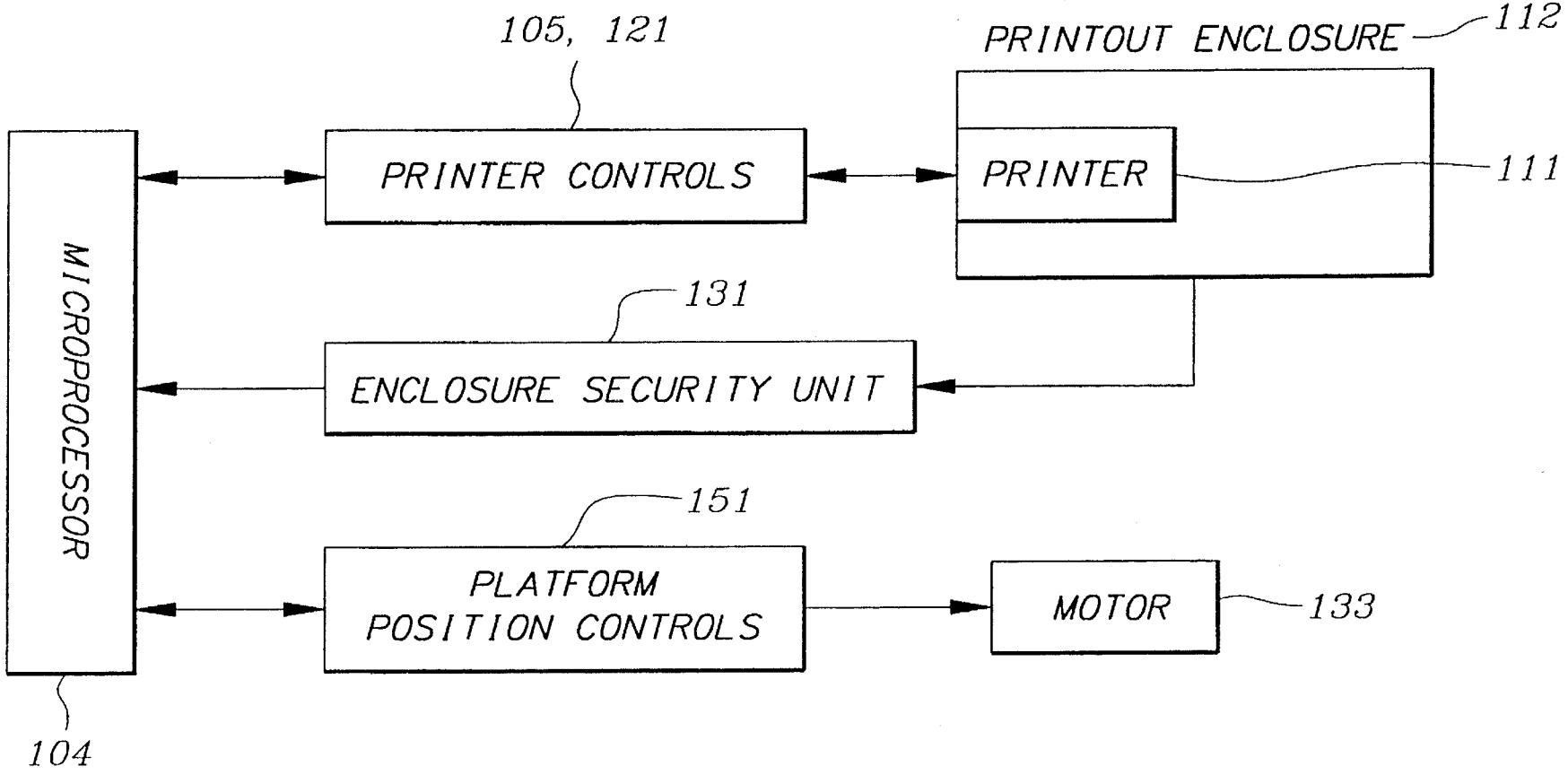
FIG. 5*c* shows a flow chart of all the components of the circuits of FIGS. 5*a* and 5*b*, which identifies each component and specifies the value thereof where applicable.

The electronic components of FIGS. 5*a* and 5*b* are laid out in the flow chart of FIG. 5*c*. This figure shows the block diagram of the printout system. The microprocessor 104 unit generates and processes data and control signals for the "PRINTER CONTROLS", 105, 121 the "ENCLOSURE SECURITY UNIT" 131, and the "PLATFORM POSITION CONTROLS" 151. The "PRINTER CONTROLS" 105, 121 block provides data for the printer 111 to print out. The "ENCLOSURE SECURITY UNIT" 131 block detects a signal if the printout enclosure 112 is tampered or broken into during a game. The "PLATFORM POSITION CONTROLS" 151 block directs a motor 131 to change the platform position. It is contemplated that this printout system could be adapted for use in other similar apparatuses.

EXAMPLE 6

APPLICATION TO NEW JERSEY PICK-6 LOTTERY

Figure 6A:
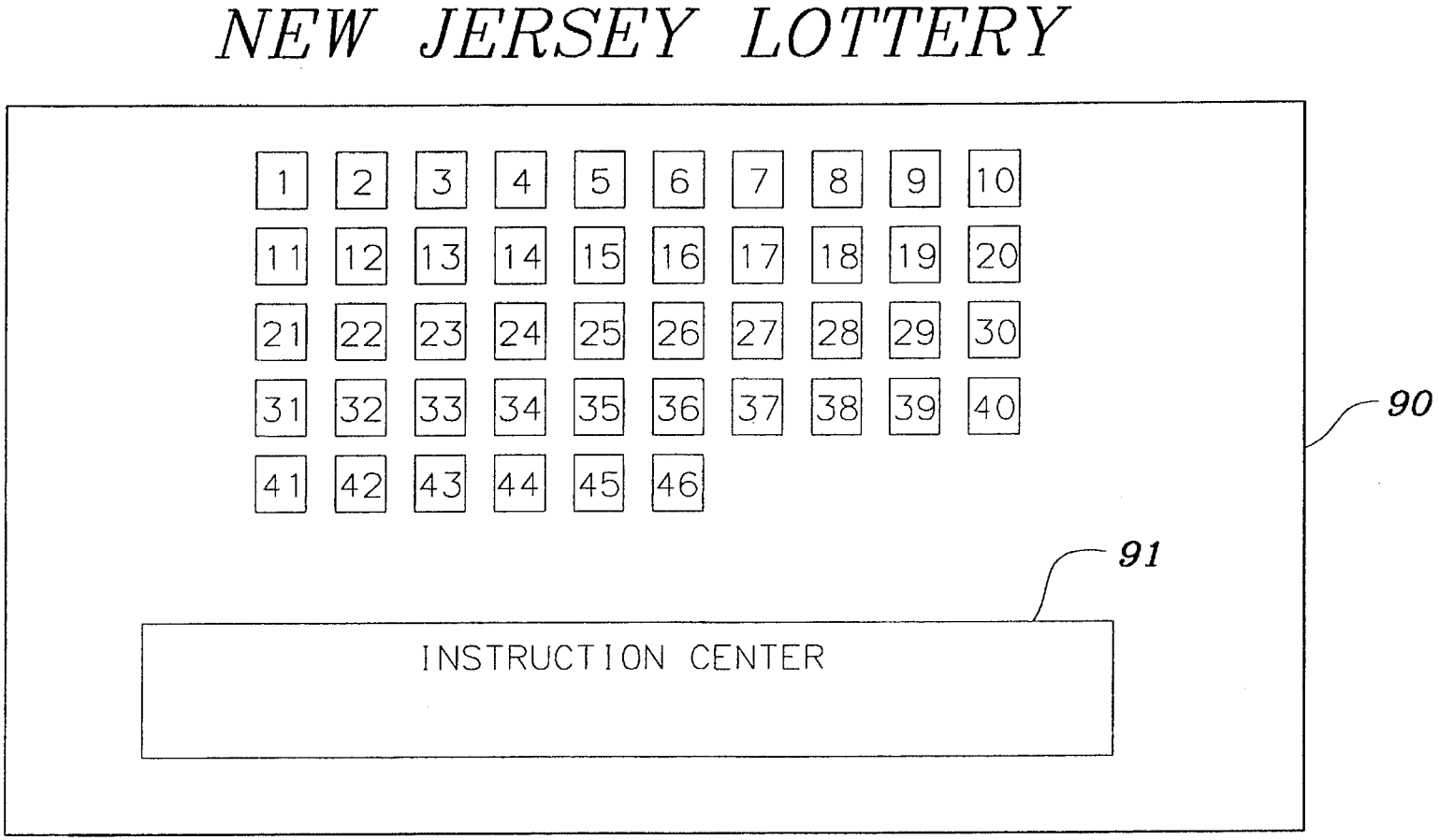
FIG. 6*a* shows the instant invention as applied to the New Jersey Pick-6 Lottery.

As illustrated in FIG. 6*a*, the printout variants of the instant invention are readily applicable to lottery games, such as the New Jersey Pick-6 Lottery, wherein the computer selects six (6) random numbers from the sequence of one (1) to forty-six (46). An instruction center area 91 is provided on the player's monitor 90 for monitoring the progress of the game. Prior to play, the computer randomly selects and prints the six (6) numbers. The player selects six (6) numbers in the manner previously described. They are revealed and flashed on the player's monitor 90. Thereupon, the computer compares the numbers which it chose to those chosen by the player, and determines whether or not a payout to the player is appropriate. The numbers which have been selected by the computer can optionally be printed or displayed on a panel at another location remote from the players monitor 90. This example is equally applicable to Pick-3, Pick-4 and other similar type lottery games.

Figure 6B:
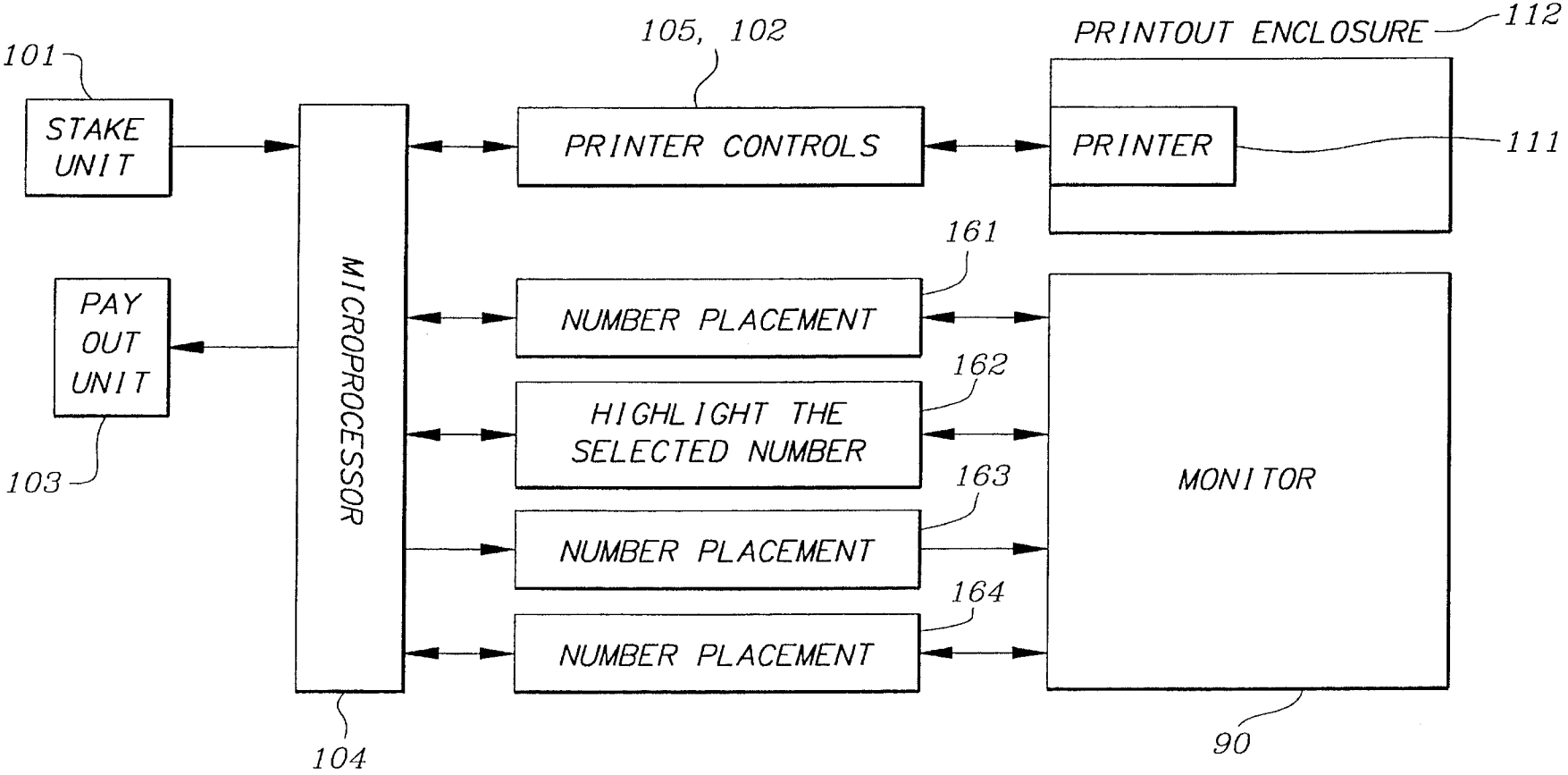
FIG. 6*b* shows a flow chart of all the components of the circuit of FIG. 6*a*, which identifies each component and specifies the value thereof where applicable.

The electronic components of FIG. 6*a* is laid out in the flow chart of FIG. 6*b*. In the lottery application, the complete game system includes blocks in the "STAKE UNIT", 101 "PAYOUT UNIT", 103 "MICROPROCESSOR" 104, "PRINTOUT CONTROLS", 105, 121 "NUMBER PLACEMENT", 161 "HIGHLIGHT THE SELECTED NUMBERS", 162 "GAME INSTRUCTIONS", 163 and "GAME OUTCOME" 164. The functions of these blocks are similar to that described in previous embodiments of the instant invention. The "NUMBER PLACEMENT" 161 stores and displays a fixed sequence of numbers for the lottery. The numbers are selected by the player by touching the screen and are stored in the "HIGHLIGHT THE SELECTED NUMBER" 162 block which highlights the numbers on the screen. The "GAME OUTCOME" 164 shows the predetermined lottery numbers and the game result for any payouts. The "PRINTER CONTROLS" 105, 121 block prints the predetermined lottery numbers before the player selects his/her numbers. The printout numbers are revealed to the player only after the player completes his/her lottery number selection.

EXAMPLE 7

APPLICATION TO KENO

As an alternative to the lottery embodiment, the instant invention is equally applicable to keno. Here, before the play begins, the computer selects twenty (20) random numbers from the eighty (80) numbers of the linear sequence of one (1) to eighty (80). The numbers are printed in their revealed form and deposited in a sealed enclosure as previously described. The player selects a set of numbers from the player's monitor as previously described. The computer compares the numbers which it selected prior to play with those selected by the player, and makes the appropriate payout to the player, as warranted. The size of the potential payout to the player is inversely proportional to the size of the pool of numbers from which the player selects.

The instant invention is equally applicable to an abundance of other embodiments, the number being limited to the number of games enjoyed by people. Therefore, the present invention can be used with games such as roulette, baccarat, bridge, craps and the like. Furthermore, other variations are contemplated such as employing a video tape to memorialize the results of a game.

Although the invention has been described with reference to certain preferred embodiments, it is understood that the present disclosure has been made only by way of example and that many variations, modifications and changes in the details of construction and the combination and arrangement of parts may be resorted to without departing from the scope and spirit of the broad principles delineated in this patent application. Hence, it is intended that the preferred embodiments and all of such variations and modifications be included within the scope and spirit of the instant invention, as defined by the following claims.

What is claimed is:

1. A microprocessor aided apparatus for simulating a game of chance for at least one player, the apparatus comprising:

means for generating a sequence consisting of a finite number of hidden elements;

means associated with said generating means for randomizing said sequence;

means associated with said randomizing means for displaying said sequence in a concealed predetermined arrangement;

means associated with said displaying means for selecting by said player, and revealing as required, as many of said hidden elements of said arrangement to complete said game;

a printer for generating a printout of all of said hidden elements of said arrangement at a beginning of said game;

a locked enclosure for displaying or receiving said printout such that said hidden elements of said arrangement are inaccessible from view;

means for viewing said printout by said player wherein said viewing means is only after said game is completed;

a plurality of platforms; and, means for rotating said platforms amongst each other to conceal said printout at the beginning of and during said game and to reveal said printout only after said game is completed.

2. The apparatus of claim 1, wherein said viewing means comprise means for transferring said printout from said printer to a position under an opaque cover located within the locked enclosure which is transparent; and, means for displacing said opaque cover from over said printout only after said game is completed.

3. The apparatus of claim 1, wherein at least one platform is transparent and at least one platform is opaque so that said printout is under said opaque platform during said game and under said transparent platform after completion of said game.

4. The apparatus of claim 1, wherein said platforms are transparent and said printout is fixedly attached to said platforms with a clip.

5. The apparatus of claim 1, wherein said displaying means and said viewing means comprise at least one video monitor.

6. The apparatus of claim 1, wherein said sequence is selected from a group consisting of at least one deck of playing cards and a finite series of sequential numbers.

7. The apparatus of claim 6, wherein said game uses playing cards and is selected from the group consisting of black jack, poker and bridge.

8. The apparatus of claim 6, wherein said game of sequential numbers is selected from the group consisting of lottery, keno and roulette.

9. A method for simulating a game of chance for at least one player, the method comprising:

generating a sequence consisting of a finite number of hidden elements;

randomizing said sequence;

displaying said sequence in a concealed predetermined arrangement;

selecting by said player, and revealing as required, as many of said hidden elements of said arrangement to complete said game;

generating a printout from a printer of all of said hidden elements of said arrangement at a beginning of said game;

displaying or receiving said printout in a locked enclosure such that said hidden elements of said arrangement are inaccessible from view; and, viewing said printout by said player wherein paid viewing is only after said game is completed; and, wherein said steps of displaying or receiving of said printout and said viewing of said printout are accomplished by the following step:

rotating a plurality of platforms amongst each other to conceal said printout at the beginning of and during said game and to reveal said printout only after said game is completed.

10. The method of claim 9, wherein said viewing step comprises; transferring said printout from said printer to a position under an opaque cover, said opaque cover being located within the locked enclosure which is transparent; and, displacing said opaque cover from over said printout only after said game is completed.

11. The method of claim 9, wherein at least one platform is transparent and at least one platform is opaque such that said printout is under said opaque platform during said game and under said transparent platform after completion of said game.

12. The method of claim 9, wherein said platforms are transparent and said printout is held by said platforms by fixedly attaching said printout to said platforms with a clip.

13. The method of claim 9, wherein said sequence consists of at least one deck of playing cards.

14. The method of claim 13, wherein said game is selected from a group consisting of black jack, poker and bridge.

15. The method of claim 9, wherein said sequence consists of a finite series of sequential numbers.

16. The method of claim 15, wherein said game is selected from a group consisting of lottery, keno and roulette.

* * * * *